US005150514A

United States Patent [19]

Seki et al.

[11] Patent Number: 5,150,514

[45] Date of Patent: Sep. 29, 1992

[54] CORRUGATING ROLL UNIT EXCHANGING APPARATUS FOR A SINGLE FACER

[75] Inventors: Yukuharu Seki; Hiroaki Sasashige; Haruo Ohkawa, all of Mihara, Japan

[73] Assignee: Mitsubishi Jukogyo Kabushiki Kaisha, Tokyo, Japan

[21] Appl. No.: 643,299

[22] Filed: Jan. 22, 1991

[30] Foreign Application Priority Data

Jan. 22, 1990 [JP] Japan ..... 2-3864

[51] Int. Cl.[5] ..... B21B 31/08

[52] U.S. Cl. ..... 29/824; 72/239; 414/911

[58] Field of Search ..... 29/822, 823, 824, 424, 29/430, 431, 700; 72/237, 238, 239; 198/468.6; 414/749, 560, 751, 753, 911

[56] References Cited

U.S. PATENT DOCUMENTS

| | | | |
|---|---|---|---|
| 3,390,040 | 6/1968 | Moser et al. . | |
| 3,638,468 | 2/1972 | Fukui et al. . | |
| 3,747,387 | 7/1973 | Shumaker . | |
| 4,222,258 | 9/1980 | Field . | |
| 4,471,515 | 9/1984 | Takenaka et al. . | |
| 4,481,066 | 11/1984 | Hirakawa et al. . | |
| 4,569,714 | 2/1986 | Tokuno . | |
| 4,627,831 | 12/1986 | Hirakawa et al. . | |
| 4,720,231 | 1/1988 | Pienta | 29/824 X |
| 4,951,386 | 8/1990 | Itano et al. | 29/824 X |

FOREIGN PATENT DOCUMENTS

| | | |
|---|---|---|
| 550897 | 1/1985 | Australia . |
| 136510 | 4/1985 | European Pat. Off. . |
| 180395 | 5/1986 | European Pat. Off. . |
| 155389 | 3/1988 | European Pat. Off. . |
| 348553 | 1/1990 | European Pat. Off. . |
| 2527819 | 12/1976 | Fed. Rep. of Germany . |
| 188861 | 10/1987 | Fed. Rep. of Germany . |
| 5036830 | 6/1974 | Japan . |
| 749735 | 5/1956 | United Kingdom . |
| 2114929 | 9/1983 | United Kingdom . |

OTHER PUBLICATIONS

European Search Report 91100333.3.

*Primary Examiner*—Timothy V. Eley

*Attorney, Agent, or Firm*—Rothwell, Figg, Ernst & Kurz

[57] ABSTRACT

An improved corrugating roll unit exchanging apparatus for a single facer is disclosed. Guide rails directed in an axial direction of corrugating rolls are disposed horizontally above a single-facer. One end of a beam is supported so as to be movable along the guide rails, and the other end thereof is supported by posts which are horizontally movable in the axial direction of the corrugating rolls. A suspending device for suspending a corrugating roll unit is held by the beam. Preferably, the beam is supported by the guide rails via drive wheels. Further preferably, the posts are formed in a gate shape, and the lower ends of the posts are supported by driven wheels adapted to roll along a pair of parallel rail tracks.

9 Claims, 3 Drawing Sheets

CORRUGATING ROLL UNIT EXCHANGING APPARATUS FOR A SINGLE FACER

BACKGROUND OF THE INVENTION

1. Field of the Invention

The present invention relates to improvements in a corrugating roll unit exchanging apparatus for a single facer in a corrugating machine.

2. Description of the Prior Art

Before describing a corrugating roll unit exchanging apparatus in the prior art to be associated with a single facer in a corrugating machine, a first description will be made concerning the construction and function of a single facer. FIG. 3 is a cross-sectional view of a general single facer. In this figure, reference character G designates a floor surface, reference numeral 11 designates an upper corrugating roll having a corrugated surface, numeral 13 designates a lower corrugating surface for shaping a core paper sheet into a corrugated form by meshing with the upper corrugating roll 11, numeral 12 designates the core paper sheet fed between the above-mentioned respective corrugating rolls to be shaped into a corrugated form, numeral 18 designates a preheat roll for preheating the core paper sheet before shaping, numeral 17 designates a pasting device for applying paste to the corrugation crest portions of the shaped core paper sheet 12, numeral 16 designates paste stored in the same device, numeral 14 designates a liner, numeral 15 designates a pressing roll for making the core paper sheet 12 pasted at the corrugation crest portions and the above-mentioned liner 14 stick together by causing them to pass between the lower corrugating roll 13 and itself under pressure, and numeral 1 designates a single-faced corrugated fibreboard produced through the operations of the above-described respective portions. It is to be noted that in the case where the core paper sheet 12 and the liner 14 are made to stick together by means of the paste 16 transferred to the corrugation crest portions, an appropriate pressing force under a given condition and heating of the paste 16 are necessary, and so, between the respective rolls are provided contact pressure adjusting devices and within the rolls 11, 13 and 15 are assembled devices for introducing steam or high-temperature oil into the rolls to be able to preset the rolls at a high temperature. In addition, the core paper sheet 12 is wound around the preheat roll 18 in the just preceding step of the process to be subjected to quality control and preliminary warm-up.

Next, description will be made of a portion R called "corrugating roll unit" which principally consists of an upper corrugating roll and a lower corrugating roll. Reference numeral 19 designates a pair of side frames for rotatably holding the shaft of the lower corrugating roll via bearings on the opposite sides thereof, numeral 21 designates a pair of arms for rotatably holding the shaft of the upper corrugating roll on the opposite sides thereof, numeral 20 designates a fulcrum shaft for rotatably connecting the same arms 21 to the side frames 19, numeral 22 designates a cylinder provided between the side frame 10 and the arm 21 for rotating the arm 21 with respect to the side frame 19 by changing its operating pressure and thereby adjusting the contact condition between the upper and lower corrugating rolls, and reference numerals 23 and 24 designate stays for connecting the pair of side frames to each other. The corrugating roll unit R assembled by engaging the upper and lower corrugating rolls via both side frames with the aforementioned structure, is fastened to a main body of a single facer by means of three bolts 9 on each side, and it can be arbitrarily attached or detached according to necessity.

By means of the single facer having the above-described structure, the core paper sheet 12 is shaped, has its corrugation crest portions pasted and is made to stick to the liner 14, and they are delivered as a single-faced corrugated fibreboard sheet 1. Depending upon a specification such as a thickness, a width and the like of the core paper sheet, the contact condition between the upper and lower corrugating rolls is adjusted by the cylinder 22. In the single-faced corrugated fibreboard sheet 1 are formed various types of flutes depending upon the corrugated wave shape, and an appropriate type is selected according to the desired use. However, since the flutes which can be formed by means of a set of corrugating rolls 11 and 13 are of only one type, upon change of the flutes as a result of order change, it is necessary to replace and exchange both the upper and lower corrugating rolls. Accordingly, in such case the corrugating roll unit R itself if exchanged.

FIG. 4 is a front view of a corrugating roll unit exchanging apparatus in the prior art, and FIG. 5 is a side view of the same apparatus. In this figure, reference character G designates a floor surface, character F designates a single facer, character R designates a corrugating roll unit forming a part of the single facer, reference numeral 19 designates side frames of the corrugating roll unit, numeral 26 designates a pair of parallel permanent rails provided above the single facer, numeral 25 designates suspending devices movably held by the respective rails and capable of suspending the corrugating roll unit via its side frames 19, numeral 27 designates a pair of parallel additional rails to be added upon exchange of the corrugating roll unit, numeral **27*a* designates connecting metals for connecting one ends of the respective additional rails to the respective ends of the permanent rails, numeral 28 designates gate-shaped posts for supporting the other ends of the above-mentioned additional rails 27, numeral 10 designates a transport truck for transporting a corrugating roll unit, numeral 10*a* designates guide rails for the same truck, arrows indicating a carry-out direction of the corrugating roll unit, and reference character S indicates a moving distance of the suspending devices. In addition, reference character R′ and reference numeral 10′ in FIG. 5 indicates the positions after movement of the items denoted by character R and numeral 10**, respectively.

In the above-described apparatus, exchange of a corrugating roll unit as a result of order change is carried out in the following manner. At first, the three fastening bolts 9 on each side (FIG. 3), which fixedly secure the corrugating roll unit R to the single facer F, are extracted and also connection of steam pipings and the like not shown is released, then the corrugating roll unit R is once hung up by means of the suspending devices (hoists) 25, subsequently it is carried out in the axial direction of the rolls to the outside, and it is placed on the transport truck 10 held in a standby state and is transported to a predetermined housing position. Subsequently, a corrugating roll unit R for the next order is carried in via the transport truck 10 up to a predetermined position on the side of the single facer. Thereafter, operations inverse to the aforementioned operations are effected to assemble the new corrugating roll unit R at a predetermined position of the single facer, and the released steam pipings and the like are reconnected.

The above-described suspending devices 25 are adapted to roll along two rails 26 installed above the single facer, extension in the lengthwise direction of these rails necessitated for carrying out the corrugating roll unit to the outside, is effected by mounting additional rails 27 detachably provided in continuation to the permanent rails 26 fixedly secured to ceiling beams above the single facer, and the free end portions of the additional rails 27 are supported by posts 28 erected on the floor. These additionally provided additional rails 27 and posts 28 are removed after replacing exchange of the corrugating roll unit R.

As described above, in the corrugating roll unit exchanging apparatus in the prior art, each time when a corrugating roll unit is to be exchanged it was necessary to connect additional rails to permanent rails fixedly secured to a ceiling and to provide posts for supporting the free ends of the additional rails, and so, upon exchange of a corrugating roll unit, complicated mount and dismount works of additional rails and the like were necessitate before and after the exchange. Consequently, there was time loss caused by the exchange work, and since the work was accompanied by danger, frequent change of flutes was so difficult that a production scheme of corrugated fibreboard sheets was largely influenced thereby.

SUMMARY OF THE INVENTION

It is therefore one object of the present invention to provide an improved corrugating roll unit exchanging apparatus which is free from the above-mentioned shortcomings in the prior art.

A more specific object of the present invention is to provide a corrugating roll unit exchanging apparatus, wherein upon exchange of a corrugating roll unit, complicated mount and dismount work of additional rails are not necessitated.

According to one feature of the present invention, there is provided a corrugating roll unit exchanging apparatus for a single facer, comprising guide rails disposed horizontally above the single facer as directed in an axial direction of corrugating rolls, a beam having one end supported so as to be movable along the guide rails and the other end supported by posts which are horizontally movable in the axial direction of the corrugating rolls, and a suspending device held by the beam for suspending a corrugating roll unit.

In operation, when a corrugating roll unit is to be carried out by means of the subject apparatus of the present invention, at first the corrugating roll unit is suspended by the suspending device, then while the suspended condition is held, the corrugating roll unit is moved sideways of the single facer by horizontally moving the beam having one end supported by posts, then lowered on a transport truck or the like in a standby state, and carried out thereby. When another corrugating roll unit is to be mounted, the corrugating roll unit is carried in through an inverse procedure. Through the above-mentioned process, exchange of a corrugating roll unit can be executed. Since the apparatus according to the present invention is a permanently equipped apparatus and it can be installed in such manner that it may be drawn out sideways of the single facer only at the time of use and normally it may be held in an accommodated condition, upon an exchange work complicated mounting works of additional rails and the like are not required.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 2:
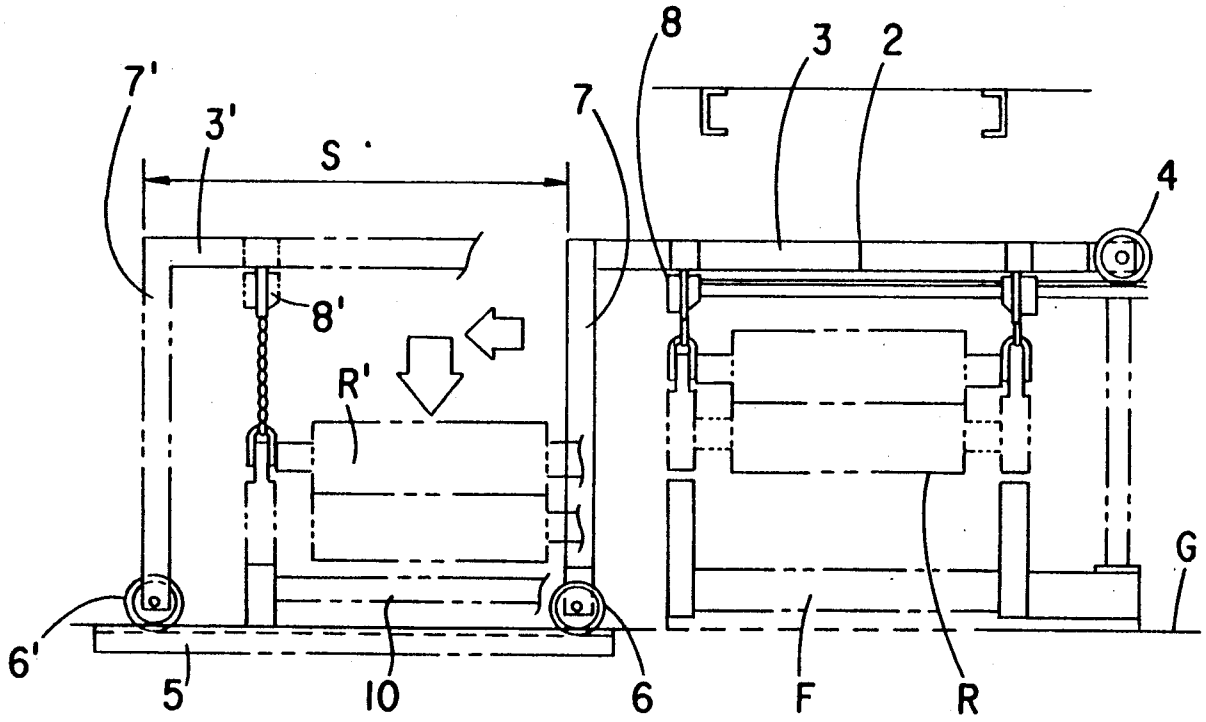
FIG. 2 is a side view of the same preferred embodiment.
Figure 1:
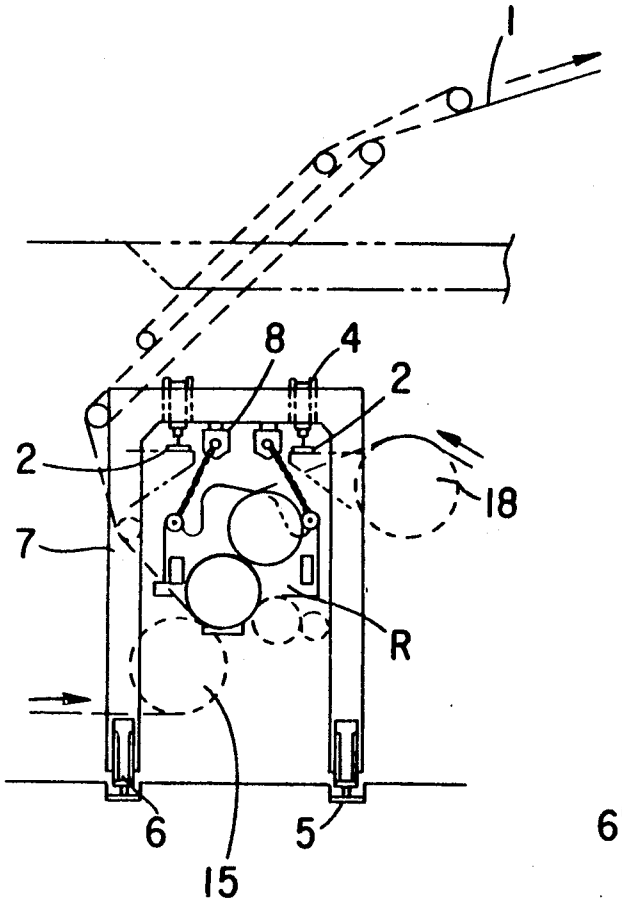
FIG. 1 is a front view of one preferred embodiment of the present invention.
Figure 3:
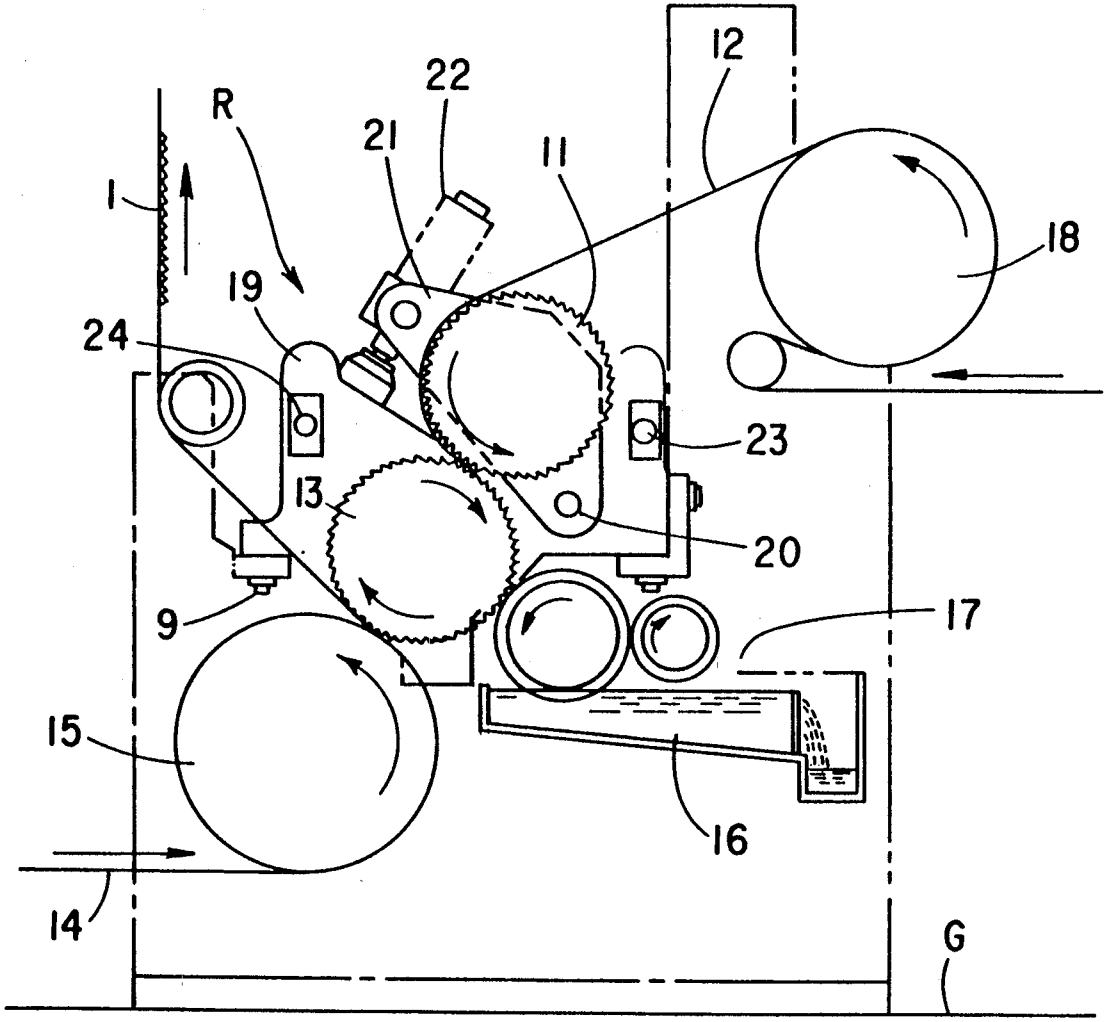
FIG. 3 (PRIOR ART)
FIG. 3 is a cross-section view of a general single facer.
Figure 4:
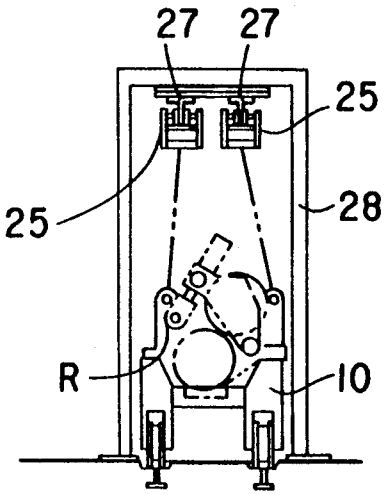
FIG. 4 (PRIOR ART)
FIG. 4 is a front view of a corrugating roll unit exchanging apparatus in the prior art.
Figure 5:
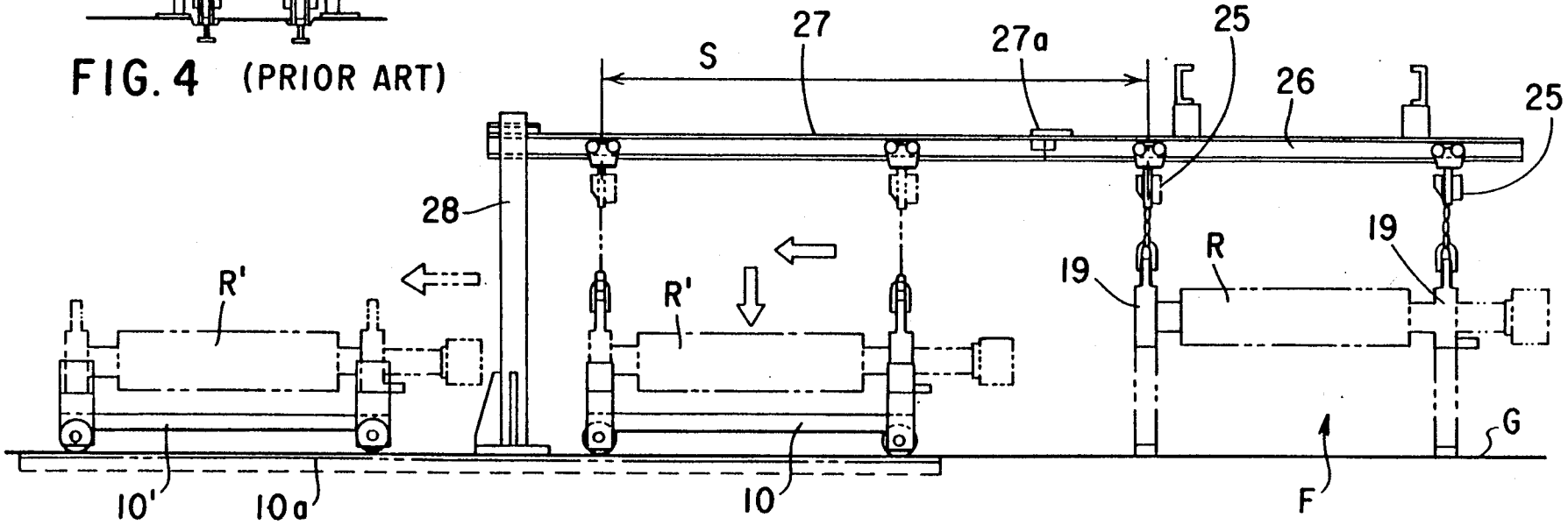
FIG. 5 (PRIOR ART)
FIG. 5 is a side view of the same apparatus.

Now, the present invention will be described in greater detail in connection to one preferred embodiment of the invention illustrated in FIGS. 1 and 2. In these figures, reference character G designates a floor surface, character F designates a single facer, character R designates a corrugating roll unit forming a part of the same single facer, reference numeral 2 designates a pair of parallel guide rails fixed above the single facer F, numeral 3 designates a pair of parallel beams provided above the same guide rails 2, numeral 4 designates drive wheels for movably supporting one end of the respective ones of the above-mentioned pair of beams on the guide rails 2, numeral 7 designates gate-shaped posts for supporting the other ends of the pair of beams 3, numeral 6 designates a pair of drive wheels which movably supported the lower ends of the same posts 7, numeral 5 designates a pair of parallel rail tracks along which the drive wheels 6 can roll, numeral 8 designates suspending devices (hoists or the like) fixed to the beams 3 for suspending a corrugating roll unit, and numeral 10 designates a transport truck for transporting the corrugating roll unit R. In FIG. 2, reference character R′ and reference numerals 3′, 6′, 7′ and 8′ represent the positions after movement of the items denoted by reference symbols R, 3, 6, 7 and 8, respectively, arrows indicate carry-out directions of the corrugating roll unit R, and reference character S indicates a distance of movement.

In the apparatus having the above-described structure, exchange of a corrugating roll unit 8 executed as a result of order change is effected in the following manner. That is, at first the bolts 9 at three locations on each side which fasten the corrugating roll unit R to the main body of the single facer, are drawn out, also connection of pipings and the like not shown is released, the corrugating roll unit R is hung up to the above by the suspending device (hoist) 8, subsequently the assembly consisting of the beams 3 and the posts 7 is made to travel in the axial direction of the corrugating rolls (to the left as viewed in FIG. 2) as driven by the drive wheels 4 and 6 while the corrugating roll unit R is kept suspended by the suspending device 8, then the corrugating roll unit R is lowered and placed on the transport truck 10 in a standby state, and it is transported to a predetermined accommodating position. In succession, another corrugating roll unit R corresponding to the next order is carried in up to a predetermined position on the side of the single facer (under the beams) by the intermediary of the transport truck 10, and thereafter, by performing the inverse operations to those described above the corrugating roll unit R is assembled at a predetermined position in the single facer F.

As described in detail above, since the corrugating roll unit exchanging apparatus according to the above-described embodiment of the present invention can be accommodated in compact close to a single facer when it is unnecessary, despite of permanent equipment it does not necessitate a broad space nor it does not spoil beautiful appearance of the apparatus. It is to be noted that as the method for moving the beams 3 and the posts 7 for suspending a corrugating roll unit, besides the illustrated method relying upon the drive wheels 4 and 6, another method such as making them slide by the intermediary of guides fixedly secured to the single facer and the ground surface G, could be employed.

In summary, the present invention is characterized in that the corrugating roll unit exchanging apparatus is permanently equipped in association with a single facer, and moreover it was formed in such structure that it can be accommodated in compact. Accordingly, the invention provides the following advantages:

(1) When a corrugating roll unit is to be mounted or dismounted, there is no need to additionally install supporting posts, additional rails and the like each time, and so great shortening of time for exchange can be achieved.

(2) In conjunction with the above-mentioned advantage, works of removing supporting posts, additional rails and the like after exchange of a corrugating roll unit become unnecessary.

While a principle of the present invention has been described above in connection to one preferred embodiment of the invention, it is intended that all matter contained in the above description and shown in the accompanying drawings shall be interpreted to be illustrative and not in a limiting sense.

What is claimed is:

1. A corrugating roll unit exchanging apparatus for exchanging a corrugating roll unit in a single facer in a corrugating machine, wherein the corrugating roll unit includes at least one corrugating roll having a longitudinal axis, said exchange apparatus comprising:

(a) guide rail means disposed horizontally above said single facer and extending in a direction substantially parallel to said longitudinal axis of said corrugating roll;

(b) a beam means having at least a first end and a second end, said first end being supported along said guide rail means, said second end being supported by a support means, said support means and said beam means being horizontally movable in a direction substantially parallel to the longitudinal axis of said corrugating roll; and (c) suspension means mounted to said beam means for suspending said corrugating roll unit.

2. The corrugating roll unit exchanging apparatus as disclosed in claim 1, wherein said beam means extends horizontally above said single facer only substantially along the length of said single facer.

3. The corrugating roll unit exchanging apparatus as disclosed in claim 1 wherein said support means comprises at least one post.

4. The corrugating roll unit exchanging apparatus as disclosed in claim 3, wherein said support means comprises a plurality of posts.

5. The corrugating roll unit exchanging apparatus as disclosed in claim 4, wherein a lower end of each of said posts is supported by at least one drive wheel adapted to roll along a pair of parallel rail tracks.

6. The corrugating roll unit exchanging apparatus as disclosed in claim 5, wherein said posts are formed in a gate shape.

7. The corrugating roll unit exchanging apparatus as disclosed in claim 1, wherein said first end of said beam means is movably supported along said guide rail means by at least one drive wheel.

8. The corrugating roll unit exchanging apparatus as disclosed in claim 1, wherein said guide rail means comprises a plurality of rails mounted above said single facer.

9. The corrugating roll unit exchanging apparatus as disclosed in claim 8, wherein said beam means comprises at least a first beam and a second beam, said first beam and said second beam are movably supported by said plurality of rails.

* * * * *